United States Patent [19]

Hawley

[11] 3,996,779

[45] Dec. 14, 1976

[54] PIPE STORAGE APPARATUS AND METHOD

[75] Inventor: Royal T. Hawley, Everett, Wash.

[73] Assignee: Western Gear Corporation, Everett, Wash.

[22] Filed: Feb. 10, 1975

[21] Appl. No.: 548,267

[52] U.S. Cl. ..... 72/142; 72/135; 72/169

[51] Int. Cl.[2] ..... B21D 7/08

[58] Field of Search ..... 72/135, 142, 169, 173, 72/371, 171, 161, 162, 137

[56] References Cited

UNITED STATES PATENTS

| | | | |
|---|---|---|---|
| 820,507 | 5/1906 | Layne | 72/137 |
| 2,091,136 | 8/1937 | Blount | 72/137 |
| 2,625,340 | 1/1953 | Beaman | 242/78 |
| 2,870,816 | 1/1959 | Greene | 72/142 |
| 3,372,461 | 3/1968 | Tesson | 29/429 |
| 3,785,587 | 1/1974 | Meyfarth | 242/82 |

*Primary Examiner*—Lowell A. Larson
*Attorney, Agent, or Firm*—Seed, Berry, Vernon & Baynham

[57] ABSTRACT

Method and apparatus for coiling long lengths of substantially rigid pipe. Sections of pipe can be welded into a length several thousand feet long which is then bent to form a continuous spiral. Preferably, the pipe is stored in a vertical coil, with the weight being carried solely by the lowermost coil.

13 Claims, 5 Drawing Figures

FIG. 1
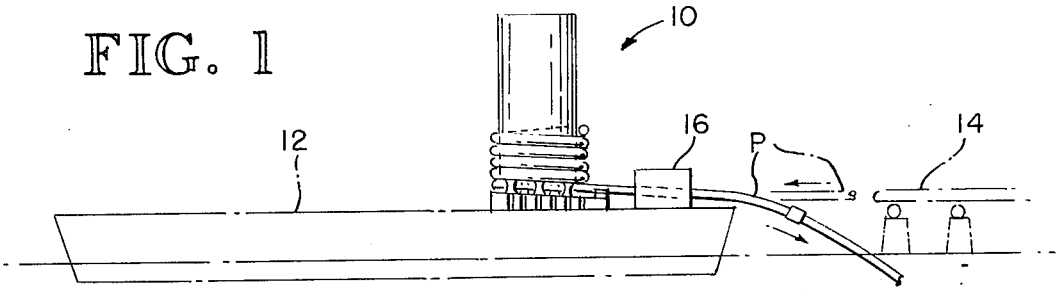
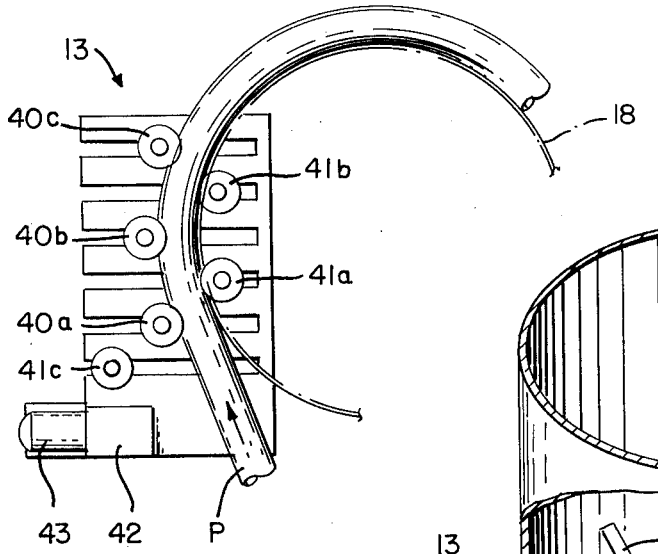
FIG. 3
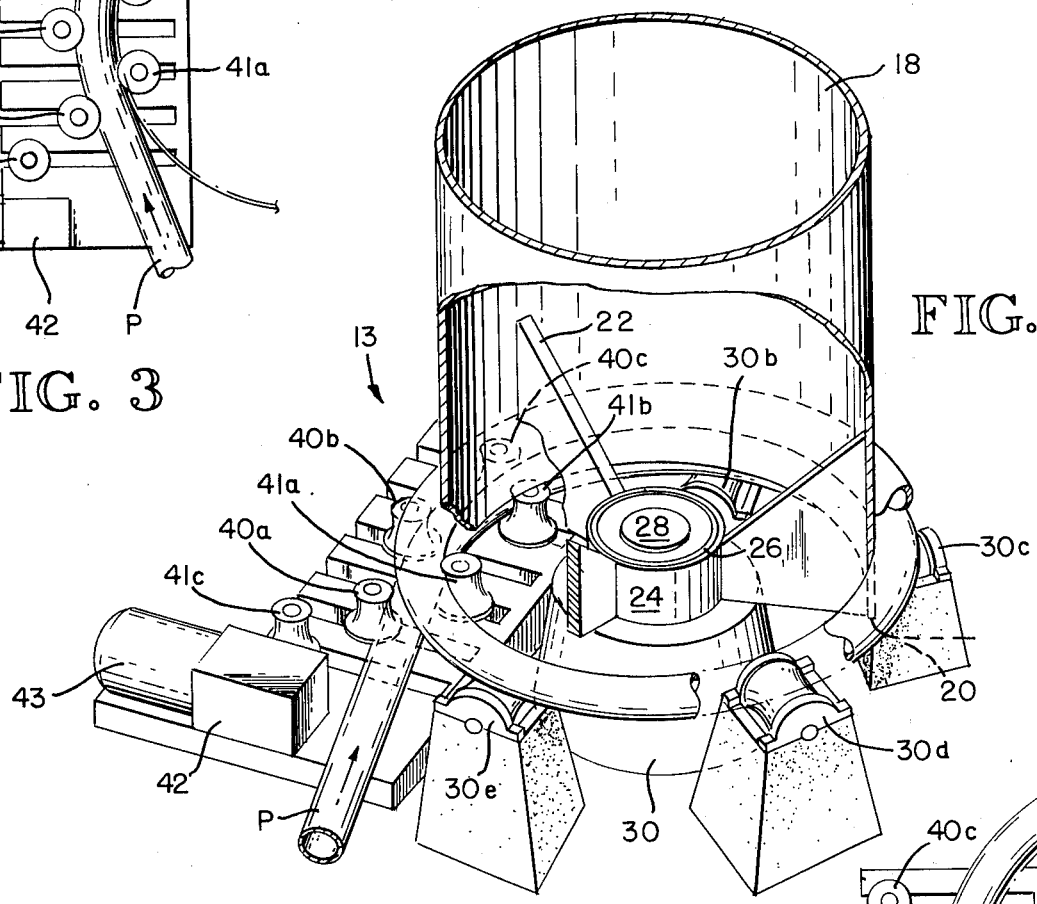
FIG. 2
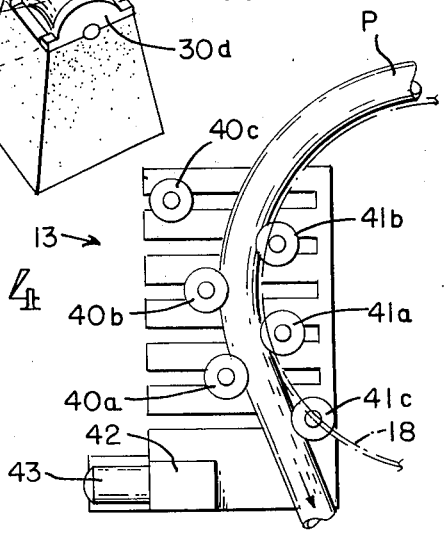
FIG. 4
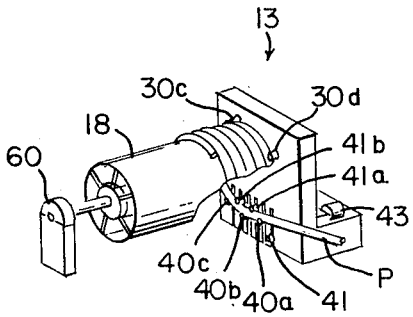
FIG. 5

PIPE STORAGE APPARATUS AND METHOD

BACKGROUND OF THE INVENTION

1. Field of the Invention

This invention pertains to coiling, storage and uncoiling of large-diameter, heavy-wall pipe in long lengths.

2. Description of the Prior Art

The customary technique for storing large-diameter, heavy-wall pipe, particularly when laying the pipe on the ocean floor, is to take sections of pipe and weld them to the end of the pipe catenary. It has long been a problem in such practice to handle and weld the sections of pipe on the crowded deck of a ship.

Another storing technique is to coil the pipe on the vessel. Various patented techniques for coiling and uncoiling pipe are shown in U.S. Pat. Nos. 2,219,811; 3,116,781; 3,685,306; 3,680,342; 3,641,778; 3,512,367; 3,237,438; 3,372,461; 3,331,212; and 928,220 and British Pat. No. 601,103. U.S. Pat. No. 3,237,438, to Tesson, basically exemplary. The technique disclosed by the Tesson patent is basicaly to form a bend in the pipe approximately of the curvature of the average diameter of the coil on a reel and then to rotate the reel to pull the pipe onto the coil. The reel in such a technique must be driven and of great strength in order to pull the bent pipe into a firm coil on the reel, primarily since the bending occurs at a location spaced from the point of tangency of the coil.

SUMMARY OF THE INVENTION

It is an object of this invention to provide a method and apparatus for laying large-diameter pipe in long lengths on the ocean floor.

It is another object of this invention to provide a method and apparatus for storing long lengths of substantially rigid pipe.

It is another object of this invention to provide method and apparatus for coiling, storing and uncoiling long lengths of heavy-wall pipe or the like.

Basically, the method of this invention is to bend an elongated member at the point of tangency of a prospective coil around a central core, pushing the bent member axially along its length to form a loop, and guiding the loop axially of the central core to form the member into a coil around the central core. The axial movement (relative to the core) of the loop can be accomplished by an axial bend simultaneously with the loop-forming bend or in a subsequent bending operation.

Basically, the apparatus is to combine a storage spool, preferably rotatable about a vertical axis, with powered support rolls at the base of the spool which are set in an inclined spiral pattern, and a bending and straightening apparatus using multiple rolls set at the base of the storage reel and tangent to the periphery of the formed coil.

The advantages of the method and apparatus are that the spool need not react against bending loads because bending occurs at the point of tangency of the coil, but rather, provides only lateral guidance and stability for the spool, particularly in the case of a spool having a vertical axis. The upper loops of the coil will all rest on the lowermost loops, which are supported by the coil-supporting rollers. While the preferred apparatus is best utilized when the axis of the spool is vertical, the axis can also be horizontal, with the loops supported on rollers lying parallel to the horizontal axis of the spool or on a spool supported by end bearings, as in conventional reels.

The term "spool" is used herein arbitrarily to distinguish from conventional reels of the type requiring structural strength sufficient to withstand bending stresses to or from the pipe, and need not rotate. Also, as used herein, a "spool" need not have a solid shell, but may have, for example, the general configuration of a lantern pinion having its circumferentially spaced rods stationary or rotatable. "Pipe", when used herein, is intended to cover thick or thin-walled pipe or tube, heavy cable or the like.

BRIEF DESCRIPTION OF THE FIGURES OF THE DRAWINGS

FIG. 1 is a schematic side elevation of a pipe-laying vessel having a storage rack embodying the principles of the invention.

FIG. 2 is a fragmentary schematic illustrating a preferred apparatus embodying the principles of the invention.

FIG. 3 is a fragmentary view of the embodiment shown in FIG. 2 with the rollers in coiling position.

FIG. 4 is a fragmentary view of the embodiment shown in FIG. 2, with the pipe-bending rolls shifted into an uncoiling position.

FIG. 5 is a modified form of the apparatus.

DETAILED DESCRIPTION OF THE PREFERRED EMBODIMENTS

As best illustrated in FIG. 1, the coiling, storage and uncoiling apparatus 10 is mounted on the deck of a pipe-laying barge 12. Pipe from a shore-based welding and assembly area is fed to the apparatus 10 in a continuous length by powered conveyor rolls 14 or a conventional pipe-laying tensioning machine. In FIG. 1, the pipe being fed to the coiling apparatus is illustrated in phantom lines. The pipe is also shown in solid lines in a pipe-discharging position after it has passed through a pipe-laying tension machine 16.

The coiling, storing and uncoiling apparatus preferably bends the pipe transversely and slightly axially of a spool 18 to an inside radius slightly larger than the outside radius of the storage spool. The lower edge 20 of the spool passes directly over the inner bending or straightening rolls. The spool 18 includes a substantially lightweight shell held substantially vertical by a plurality of arms 22. The arms are joined to a hub 24 that is supported by a bearing 26 on a stub shaft 28 of a large base 30. Although the spool 18 is free to rotate about a vertical axis, it is not independently powered.

A plurality of powered support rolls **30*a*–30*e* are set in an inclined spiral pattern so that one wrap of the bent pipe moves vertically of the spool axis one pipe diameter. That is, powered roller 30*a* is at the lowest vertical height, substantially aligned with the pipe P as it leaves a bending apparatus 13.** Each next successive roll is slightly higher in elevation so that a formed loop or wrap of the pipe is guided vertically upwardly along the spool one loop thickness for each revolution of the spool. As additional pipe is bent, the succeeding coils of pipe are forced upward over the outer shell of the spool. The spool does not support the weight of the pipe nor participate in the bending operation but merely guides the coils so that they lie in an orderly, vertical pattern. Further advancing of the pipe will produce a coil of pipe a single layer (radially of the spool) in thickness and as long as is desired, being limited only by the height of the spool and the ability of the bottom wrap of pipe to support the rest of the coil without flattening where it is engaged by the support rollers.

The pipe can be bent transversely while being fed through the bending apparatus 13 on an incline equal to the helix angle of the coil on the spool. Alternatively, the pipe can be fed through the bending apparatus horizontally and the rollers 30*a*–30*e* will deflect the pipe elastically, within its elastic limit, upwardly to form a spiral. As the rollers 30*a*–30*e* deflect the pipe upwardly, it will also twist slightly in the bending apparatus and, as a result, a compound transverse and slightly vertical bend will result to assist in forming the coil.

As an example, a coil 100 feet in diameter of 12-inch diameter steel pipe will contain 3,140 feet in each 10 feet of its length and will weigh at least 120 short tons, based on ⅝-inch wall thickness. A 100 foot high coil, therefore, would weigh 1200 tons. Larger diameter pipe will be heavier for the same height of a single layer coil.

The pipe is pulled and formed into the coil by the bending apparatus 13. The bending apparatus can be of the type described in said earlier-mentioned patents, such as U.S. Pat. No. 928,220, for example, or otherwise of conventional construction. In the preferred embodiment, the bending apparatus includes three outer bending rolls 40*a*–40*c* and two inner bending rolls 41*a* and 41*b*. The rolls are power driven through a gear box 42 and and a motor 43 or by any other conventional manner. Preferably, the rollers are each set independently in tracks 44 so that the bending apparatus can be converted to a straightening apparatus merely by shifting rollers 40*b* and 40*c* to the right, as viewed in FIG. 2, moving roller 40*c* out of contact with the pipe, and bringing into contact with the pipe an additional roller 41*c*. In this manner, and with the rollers rotated in the reverse direction, pipe will be pulled from the storage coil and straightened simultaneously. Straightening is facilitated in this manner since the bottom of the pipe coil extends downwardly below the lower end of the storage spool, making the space available for bending rolls on the inside of the pipe coil. The straightening apparatus can also be employed to grip the pipe at a desired tension to maintain the tension on the pipe string to the ocean bottom, if desired.

While the benefit of reduced spool costs is best employed with a spool mounted about a vertical axis, the spool can also be rotated about a horizontal axis. The embodiment shown in FIG. 5 illustrates bending apparatus 13 and spirally arranged, end support rollers 30*a*–30*e*. The spool 18 in this embodiment, however, is rotatably supported at opposite ends on bearing posts 60. While the bearings of the bearing post will have to support the weight of the spool and pipe, the spool and bearings will not have to be of the greater strength necessary to withstand the pipe-bending forces such as in conventional reels.

While the preferred embodiments of the invention have been illustrated and described, it should be understood that variations will be apparent to one skilled in the art without departing from the principles herein. Accordingly, the invention is not to be limited to the specific embodiments described.

I claim:

1. A method of coiling a long length of heavy duty pipe, comprising:

advancing the pipe along a path through a bending station, bending the advancing pipe at the bending station about a generally vertical axis of a guide cylinder by applying circumferentially-spaced bending forces from within a vertical cylindrical guide path and circumferentially-spaced bending forces from without the vertical cylindrical guide path to form the pipe into a partial first convolution, guiding and supporting the advancing bent pipe at circumferentially and progressively axially spaced locations along the cylindrical guide path to form a completed first convolution of a diameter slightly larger than said guide cylinder immediately beyond said bending station, which convolution is progressively axially inclined along the cylindrical guide path, moving the first convolution lengthwise of the guide cylinder along the vertical cylindrical guide path by progressively forming a second convolution of the same diameter as the first convolution in the advancing pipe in the same circumferential plane below the first convolution in the same way that the first convolution was formed, and continuing to form in the advancing pipe additional convolutions one on another in the same manner and each in the same circumferential plane encircling the guide cylinder so that the weight of all of the convolutions is carried at said circumferentially and progressively axially spaced locations.

2. A method of coiling a long length of large diameter pipe into a vertical coil with multiple spiral convolutions, comprising:

advancing the pipe along a path through a stationary bending station, bending the advancing pipe at the bending station to a circular curvature about and below a guide cylinder having a center by applying on the pipe radially inwardly directed circumferentially spaced bending forces and radially outwardly directed circumferentially-spaced bending forces, guiding and supporting the bent pipe immediately leaving the bending station at progressively circumferentially and vertically higher locations equally spaced from a vertical axis through said center as the pipe advances along a first spiral convolution from the bending station, the progressing elevation of said locations along the first spiral convolution being in accordance with the lead of the spiral, vertically guiding and progressively supporting a second convolution of the same curvature and in the same circumferential plane as the first spiral convolution by forming the second convolution in the same way that the first convolution was formed, and continuing to form from the advancing pipe additional spiral convolutions guided one on another about the guide cylinder and in the same circumferential plane in the same manner and with the weight of all of the convolutions being carried through the lowermost convolutions to said progressively circumferentially and vertically higher spaced locations for support.

3. A method of handling a long length of heavy duty hollow pipe, comprising:

applying forces on the pipe for advancing the pipe lengthwise along a straight path tangent to a guide spool, bending a portion of the advancing pipe at said point to a curvature having the axis of the spool at its center by applying radially inwardly directed circumferentially spaced bending forces and radially outwardly directed circumferentially spaced bending forces on the pipe, and applying forces on the same portion of the bent pipe at progressively circumferentially and vertically higher spaced locations for supporting and guiding the bent portion of moving pipe upwardly from said tangency point through a bottom convolution in a path helical to the spool, repeating such bending and force applying steps on subsequent portions of the pipe causing the pipe to coil in response to the forces causing advancement of the pipe along the pipe length and the forces at the progressively circumferentially and vertically higher spaced supporting and guiding locations, progressively upward around the spool in a single radial layer of multiple convolutions resting vertically on one another and collectively supported by the support given to the bottom convolution while being retained in vertical alignment by the spool.

4. A method according to claim 3 in which the coiled pipe is unwound from the spool and straightened for use by progressively moving the bottom convolution of the pipe back along a straight path while reversely bending the pipe into its original form at said point of tangency.

5. A method according to claim 3 in which the spool rotates as the convolutions advance therearound.

6. A method according to claim 3 in which said pipe is large-diameter steel pipe formed by multiple lengths welded together in said straight path while is being moved lenthwise therealong.

7. A method of coiling a long length of large diameter pipe, comprising:

advancing the pipe along a path through a bending station, cold bending the advancing pipe at the bending station beyond its elastic limit to a generally circular curvature of a first diameter about a cylinder having a center axis by applying on the pipe radially inwardly directed circumferentially spaced bending forces and radially outwardly directed circumferentially spaced bending forces, guiding the advancing, circularly bent pipe beyond the bending station through a first spiral convolution of said first diameter and having its axis passing through said center axis, progressively circumferentially and vertically axially guiding the first spiral convolution in a vertically inclined path along said center axis by forming a second convolution in the advancing pipe of said first diameter and in the same manner as the first convolution and in the same circumferential plane as the first convolution, and continuing to form in the advancing pipe additional convolutions of said first diameter and in the same circumferential plane in the same manner and with the upper convolutions being moved along the cylinder by the formation of the next succeeding lower convolution while guided along said cylinder.

8. Apparatus for coiling a long length of a bendable member of uniform cross-section, comprising:

axial elongated guide means occupying a generally cylindrical guide path and having an infeed end, bending means axially spaced from said guide means and located adjacent the infeed end thereof, said bending means being adapted to bend said member into a circular curvature concentric with such path, means for advancing said member through said bending means from a feed path, and spiral guide means between said bending means and said elongated guide means for guiding the member in a first spiral convolution from said bending means into a position to thereafter be guided by said axial elongated guide means therealong responsive to the advance of additional spiral convolutions formed in said member in like manner, said axial guide means being vertical and said spiral guide means carrying the weight of the spiral convolutions thereabove.

9. Apparatus according to claim 8 in which said spiral guide means comprises a series of circumferentially spaced rollers progressively spaced around and along said cylindrical guide path in accordance with the lead of the spiral convolutions.

10. Apparatus according to claim 8 in which said bending means comprises multiple bending rollers which are adjustable to create a reverse bend in the member so that a coiled member on the axial elongated guide means can be uncoiled for use in a straight form.

11. Apparatus according to claim 8 in which said bending means comprises multiple bending rollers, some of which are located radially outward of said cylindrical guide path and others of which are located radially inside of said cylindrical guide path.

12. Apparatus for coiling a long length of a bendable member of uniform cross-section, comprising:

axial elongated guide means occupying a generally cylindrical guide path and having an infeed end, bending means axially spaced from said guide means and located adjacent the infeed end thereof, said bending means being adapted to bend said member into a circular curvature concentric with such path, means for advancing said member through said bending means from a feed path, and spiral guide means between said bending means and said elongated guide means for guiding the member in a first spiral convolution from said bending means into a position to thereafter be guided by said axial elongated guide means therealong responsive to the advance of additional spiral convolutions formed in said member in like manner, in which said axial elongated guide means comprises a rotatable spool with a periphery and a vertical axis, said bending means including bending rollers spaced for bending the member into a convolution beneath said spool outside of said periphery, and said spiral guide means comprises circumferentially spaced rollers immediately below and outside of said periphery advancing progressively in the axial direction from said bending rollers to said spool.

13. Apparatus for coiling a long length of a bendable member of uniform cross-section, comprising:

axial elongated guide means occupying a generally cylindrical guide path and having an infeed end, bending means axially spaced from guide means and located adjacent the infeed end thereof, said bending means being adapted to bend said member into a circular curvature concentric with such path, means for advancing said member through said bending means from a feed path, and spiral guide means between said bending means and said elongated guide means for guiding the member in a first spiral convolution from said bending means into a position to thereafter be guided by said axial elongated guide means therealong responsive to the advance of additional spiral convolutions formed in said member in like manner, said bending means comprises multiple bending rollers, some of which are located radially outward of said cylindrical guide path and others of which are located radially inside of said cylindrical guide path.

* * * * *